US005352873A

United States Patent [19]

Carlsson et al.

[11] Patent Number: 5,352,873

[45] Date of Patent: Oct. 4, 1994

[54] MICROWAVE OVEN CAVITY INCLUDING A GRILL ELEMENT

[75] Inventors: Kurt H. Carlsson; Dan Carlsson, both of Norrköping, Sweden

[73] Assignee: Whirlpool Europe B.V., Veldhoven, Netherlands

[21] Appl. No.: 74,181

[22] Filed: Jun. 9, 1993

[30] Foreign Application Priority Data

Jun. 10, 1992 [SE] Sweden ..... 9201786-2

[51] Int. Cl.[5] ..... H05B 6/72

[52] U.S. Cl. ..... 219/685; 219/746; 219/750

[58] Field of Search ..... 219/10.55 F, 10.55 B, 219/10.55 A, 10.55 E, 10.55 R, 685, 695, 696, 745, 746, 750

[56] References Cited

U.S. PATENT DOCUMENTS

| | | | |
|---|---|---|---|
| 2,943,175 | 6/1960 | Guanella | 219/746 |
| 3,843,862 | 10/1974 | Staats | 219/10.55 F |
| 3,845,267 | 10/1974 | Fitzmayer | 219/10.55 F |
| 4,335,289 | 6/1982 | Smith | 219/10.55 F |
| 4,477,706 | 10/1984 | Mittelsteadt | 219/10.55 B |
| 5,082,999 | 1/1992 | Yamaguchi et al. | 219/10.55 B |

FOREIGN PATENT DOCUMENTS

| | | |
|---|---|---|
| 0226407 | 6/1987 | European Pat. Off. . |
| 0380158 | 8/1990 | European Pat. Off. . |
| 0402819 | 12/1990 | European Pat. Off. . |
| 0420319 | 4/1991 | European Pat. Off. . |
| 0478053 | 4/1992 | European Pat. Off. . |
| 4025734 | 2/1992 | Fed. Rep. of Germany . |
| 2237487 | 5/1991 | United Kingdom . |

OTHER PUBLICATIONS

IEEE Transactions on Industry and General Applications-vol. IGA-6, No. 1, Jan. 1970, New York U.S.-pp. 74-80 H. S. Hauck 'Design Considerations for Microwave Oven Cavities'.

*Primary Examiner*—Philip H. Leung

*Attorney, Agent, or Firm*—Robert O. Rice; Stephen D. Krefman; Thomas J. Roth

[57] ABSTRACT

A microwave oven with an oven cavity and a microwave feed system which produces a microwave distribution of polarized microwaves with essentially defined field vector orientations relative to one of the walls of the cavity. A zone defining an expansion of volume which opens into the cavity and whose dimensions are tuned to the wavelength and field distribution in the cavity, is disposed in a wall of the cavity. The expansion does not affect the effective field distribution in the cavity and can be used for concealed placement of a grill element or light source.

5 Claims, 2 Drawing Sheets

MICROWAVE OVEN CAVITY INCLUDING A GRILL ELEMENT

Figure 1:
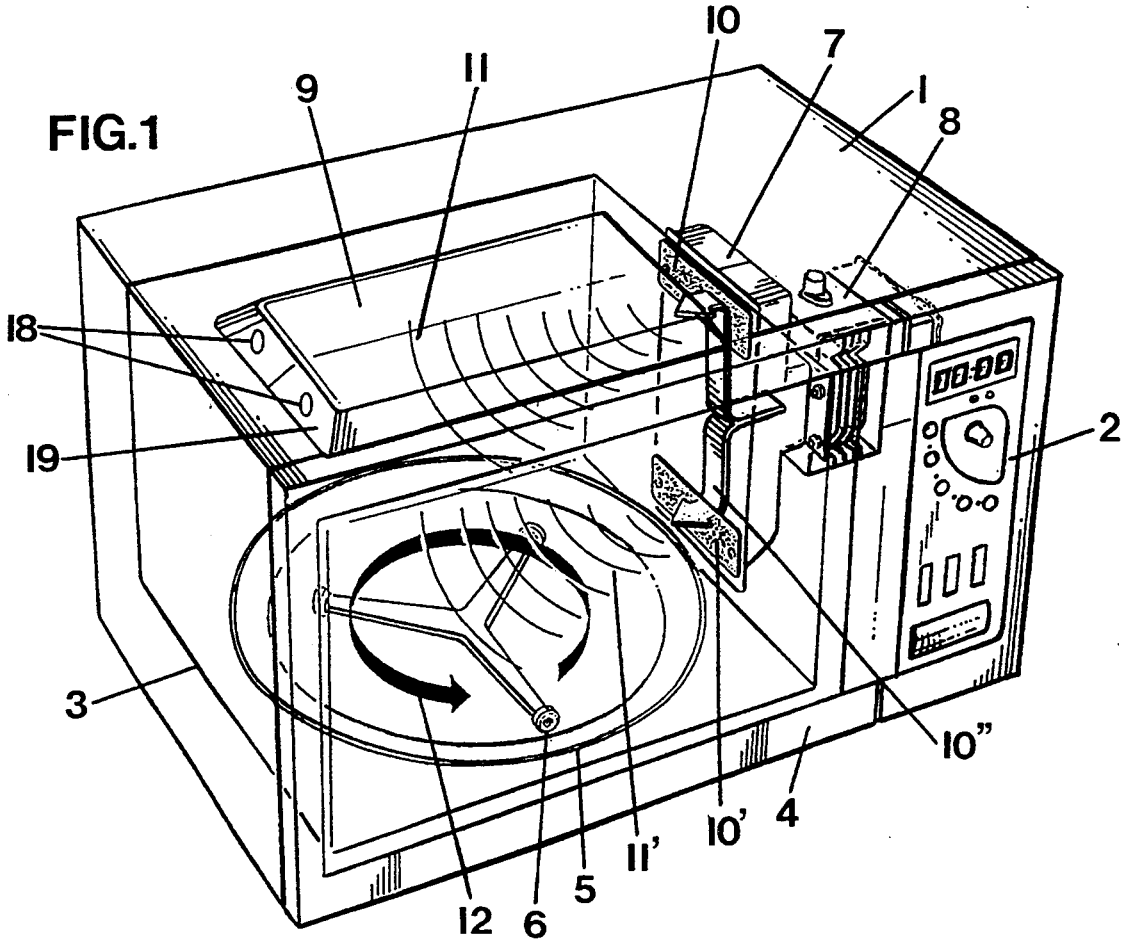

The present invention relates to a microwave oven comprising an oven cavity into which a food item is placed during cooking, the cavity being enclosed by walls in conjunction with an oven door, and a microwave source with associated microwave input means for producing a microwave field in the cavity during the cooking operation.

A microwave oven of the above mentioned type is disclosed in Swedish patent specification no. 9003012-3. This describes an arrangement in which the input means is in the form of a resonant waveguide device for directing a phase locked and coherent microwave transmission into the oven cavity via two input apertures located in a lateral walls, adjacent the floor and the roof respectively. In one embodiment, the microwaves are supplied as polarized waves with a substantially vertical electric field vector, E-vector, and a substantially horizontal magnetic field vector, H-vector. In such an oven, the microwave field has proven to be essentially unaffected by variations in the actual load, i.e. food items of various sizes and consistencies.

A general objective in the construction of microwave ovens, and in particular ovens for household use, is to provide the oven cavity both with a good usable volume and good field distribution, while maintaining acceptable outer dimensions for the oven unit. This objective has led to today's microwave ovens usually having cavities in the form of a right-angled paralleliped with a generally greater breadth than height. The difficulty of providing a good usable volume is exacerbated nowadays because it is often necessary for the cavity to have room for such fittings as a grill element in the roof of the cavity, a rotating bottom plate on the floor of the cavity and, as usual, adequate oven lighting. These fittings usually encroach to some degree on the usable volume of the cavity and can also cause disturbances in the microwave field with consequent deterioration in cooking performance. Additionally, the limited dimensions of the oven cavity often prevent the use of common cooking receptacles in the oven.

The object of the present invention is to avoid the above shortcomings of previously known oven constructions, by providing a microwave oven with a more versatile usable oven volume, with improved placement of oven fittings and which allows the use of cooking receptacles of greater outer dimensions than would normally fit in an oven cavity.

In pursuit of these objectives, the invention provides a microwave oven of the type described in the introduction which is characterized in that a zone defining an expansion of volume, opening into the cavity, is disposed in a wall of the cavity, that the dimensions of the expansion are tuned to the wavelength and field pattern of the microwave field in the cavity whereby the length of the expansion in the direction of microwave propogation along said wall essentially corresponds to a whole number of microwave half wavelenths, and that said input means is arranged to input microwaves which are polarized such that the electric field vector of the microwave field forms substantially at right angles with said wall and the magnetic field vector of the microwave field is directed substantially parallel with said wall.

Such an expansion has essentially no adverse effect on the important part of the microwave field distribution in the load zone where the item of food is placed and cooked. The defined dimensioning can be said to induce the field in the cavity to be mirrored within the expansion via a fictional electrically conductive separating wall between the cavity and the expansion.

The expansion of the invention provides advantages in manufacturing, especially large scale production, because the same cavity construction can be used in diverse models within an oven family. The expansion of the oven cavity can be used to simply adapt ovens to different market needs and use objectives. The expansion can even be left out without necessitating a redimensioning of the cavity and the microwave input system.

A preferred embodiment of the microwave oven of the invention has the expansion disposed in the roof of the oven cavity. This measure provides extra headroom in the cavity and makes it possible to use receptacles which do not normally fit in a microwave oven. For example, babyfood can be directly warmed up in a baby feeding bottle.

A particularly preferred embodiment of the microwave oven of the invention comprises a grill element which is disposed in the expansion. The expansion itself may be configured as a reflector to direct heat radiation from the grill element towards the load zone of the oven. In this fashion, the grill element is concealed and does not encroach on the usable volume of the oven while, at the same time, its grilling power is improved giving rise to the possibility of using a smaller grill element. By configuring the grill element as a substantially straight or spiral heating filament extending substantially parallel with the plane of the roof of the cavity, i.e. substantially coplanar with the magnetic field vector, a small current is induced in the filament which facilitates sealing of the filament within its passage through the wall of the expansion.

A further development of the embodiment described immediately above covers the expansion and its accompanying grill element with a protective sheet having perforations to allow heat radiation to penetrate through. This has the advantage of providing an essentially even roof surface in the cavity and facilitates cleaning of the oven. During use, direct touching of the grill element with its attendant risk of burn injury is prevented.

Additional embodiments are set out in the following claims.

Figure 2A:
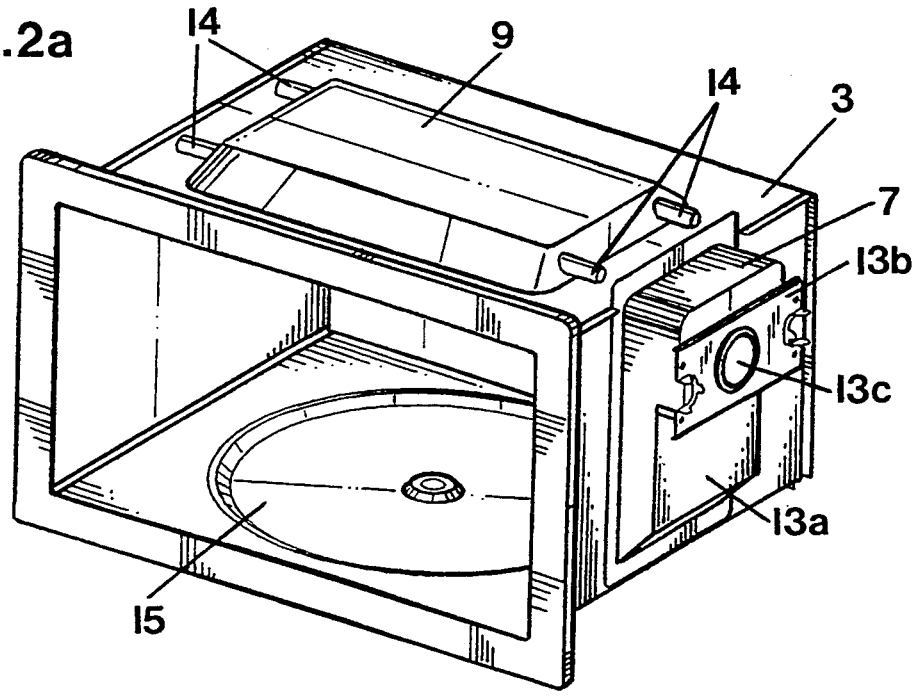
Figure 2B:
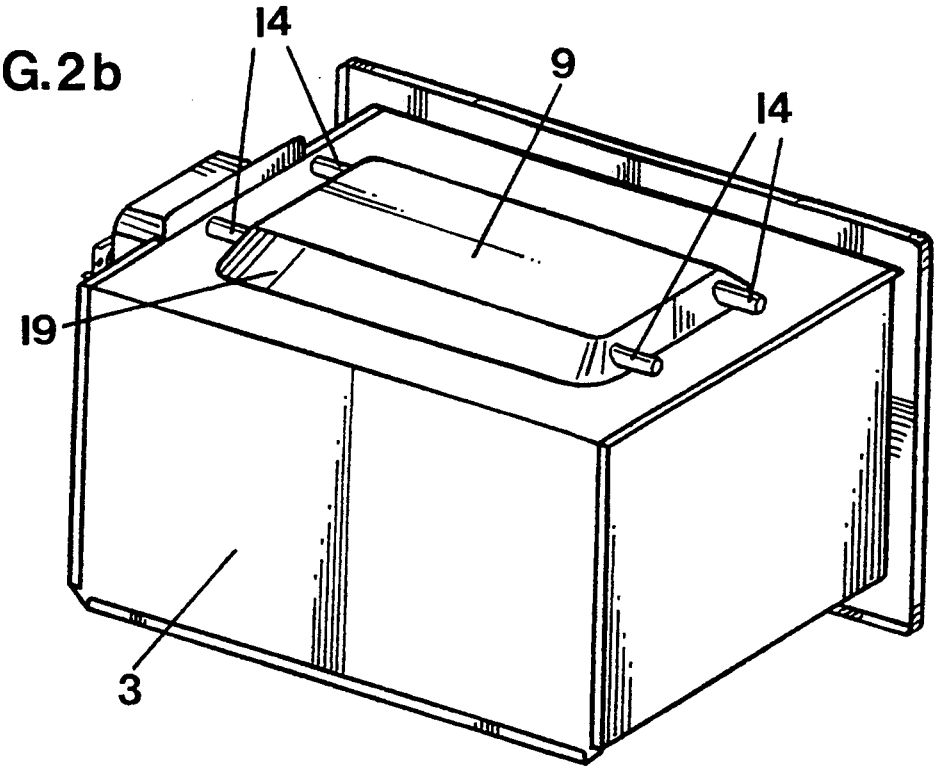
Figure 2C:
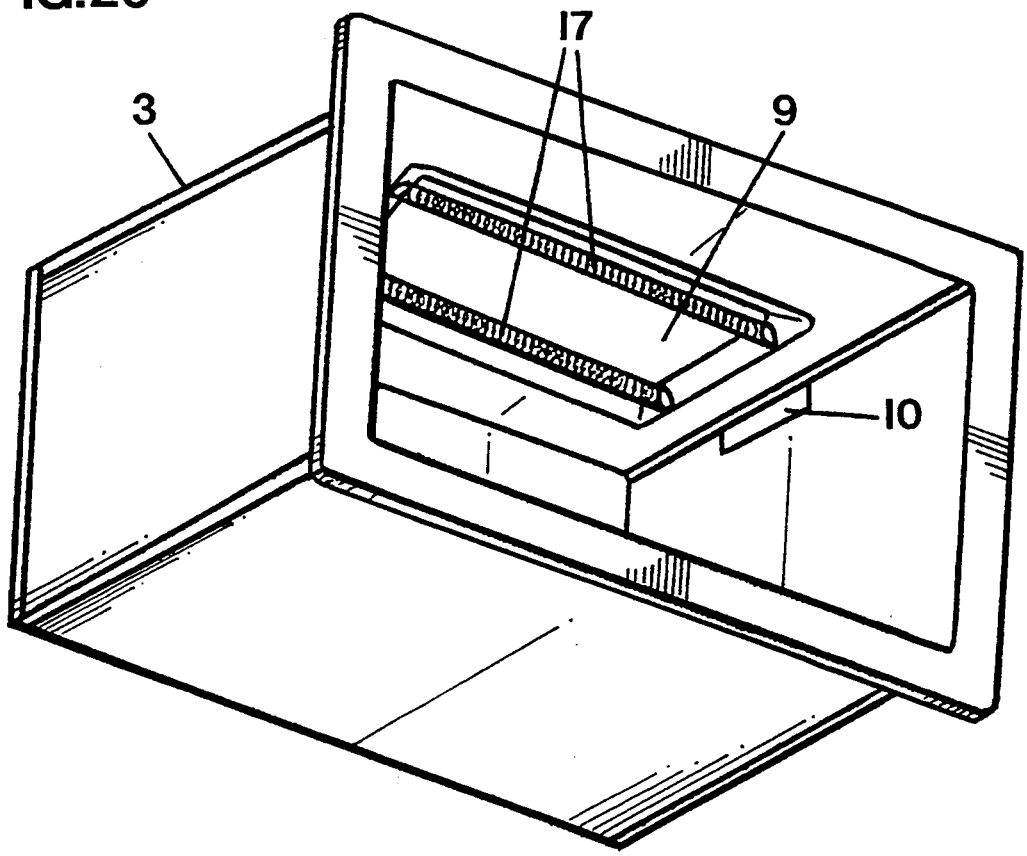

In the description which follows, an embodiment of a microwave oven in accordance with the invention is described with reference to the drawings in which:

FIG. 1 is a partial perspective view of the microwave oven of the invention with a schematically illustrated oven cavity provided with an expansion in the cavity roof;

FIG. 2*a* is a front perspective view of the microwave oven having an expansion in the cavity roof;

FIG. 2*b* depicts the the oven cavity of FIG. 2*a* in perspective, from the back; and FIG. 2*c* depicts the oven cavity of FIG. 2*a* in perspective, obliquely from the front and beneath illustrating the inside of the cavity with its expansion and accompanying grill element.

FIG. 1 is a partial perspective view of a microwave oven in housing 1, a control panel 2 and, disposed in the housing, a cavity 3 into which a food item is placed during the cooking process. A door 4 is provided which shuts the cavity tight during cooking. Set in the floor of the cavity is a rotating bottom plate 5 with its rotation mechanism 6. The bottom plate 5 receives the dish upon which the food item is placed and, during cooking, rotates it in the direction indicated by arrow 12. The bottom plate and rotation mechanism may be of a construction allowing easy removal, as shown in FIG. 2*a*, in case it is desired to maintain the food item stationary during cooking. The space over the bottom plate defines the load zone of the cavity.

FIG. 1 also shows a microwave input means 7 and a microwave generator 8 for producing the microwaves. Via the input means 7, microwaves are directed through two feed apertures 10 and 10' respectively disposed in a lateral wall adjacent the floor and roof of the cavity. The propogation of microwaves through the input means 7 and out through apertures 10 and 10' is illustrated with double arrow 10''. The propogation of microwaves within the cavity 3 is illustrated with ripple lines 11 and 11' which indicate that the propogation direction is from right to left in this drawing.

The input means 7 and feed apertures 10 and 10 are arranged to direct, into the cavity, polarized microwaves whose E-vector is substantially vertical and whose H-vector is substantially horizontal. This means that the microwave field formed in the cavity has an E-vector substantially at right angles to the roof of the cavity whereas the H-vector extends substantially along the roof. The precise details of the microwave feed are not critical to understanding the invention. Input means 7 and apertures 10, 10', for example, can be as described in Swedish patent specification no. 9003012-3, and reference is made to this document for a detailed description. Similarly, the precise form of the control panel 2 is not critical, and for construction details, reference may be had to microwave ovens already on the market.

A volumetric expansion 9, which essentially has the form of a flat, rectangular box-shape, is disposed in the roof of the cavity. In this analogy, the roof of the expansion is defined by the broad, upper face of the box, while the lower, open broad face defines the opening of the expansion into the cavity and is substantially coplanar with the roof of the cavity. The area of the roof of the expansion is somewhat smaller than its opening as the skirting edge walls 19 are somewhat inclined. Schematically shown in the short side of the expansion are two apertures 18 which can serve for the passage of electrical connections to fittings within the expansion.

The expansion in this embodiment has a length of approximately 250 mm in the direction of microwave propogation, a breadth of approx. 150 mm and a depth of approx. 20 mm, while the microwave generator has a frequency of 2.45 GHz. This means that the length is of the order of magnitude of two wavelengths, the breadth is of the order of magnitude of one wavelength and the depth more or less half of a wavelength. With these proportions, the expansion is tuned to the wavelength and the field pattern in the cavity although this is principally achieved by the length being approximately a whole number of half wavelengths. The breadth and depth are less critical to tuning. By tuning the expansion, the field pattern in the cavity is "mirrored" within the expansion and therefore does not affect the part of the field in the load zone which is important to the cooking process, even if the volume of the expansion is proportionately large and makes up several per cent of the total volume of the cavity.

FIG. 2*a* shows the demounted oven cavity in perspective, obliquely from the front. The cavity is manufactured from sheet metal which has been surface treated in a conventional fashion, for example painting or enamelling. Alternatively, the sheet metal may be stainless sheeting depending on the type of oven the cavity is to be used in. The bottom plate 5 and its rotation mechanism 6, shown in FIG. 1, have been omitted in this drawing and the floor of the cavity presents a round recess 15, in which the supporting wheels of the rotation mechanism roll during its rotation, and a communicating hole for a motor driveshaft which engages the rotation mechanism 6 when it is set in place.

FIG. 2*a* also shows the expansion 9 in the roof of the cavity. A pair of through holes 14 are provided at each end of the expansion intended for electrical cables to a grill element 17 which is disposed in the expansion as shown in FIG. 2*c*. The abovementioned input means 7 is shown adjacent one of the lateral walls of the cavity. In this embodiment, the input means comprises a relatively long flat waveguide 13*a* which is disposed vertically along, and shares a common wall with, the lateral wall. The microwave generator 8, shown in FIG. 1, is a magnetron which has been omitted in this drawing so as to reveal an attachment means 13*b* for securing the magnetron to waveguide 13*a* and comprising a circular aperture 13*c* for the passage of a magnetron antenna into the waveguide.

FIG. 2*b* shows the cavity of FIG. 2*a*, in perspective, obliquely from the back, including the expansion 9 in the roof of the cavity and through holes 14. In this figure, the skirting edge walls of the expansion incline inwardly towards the centre of the roof of the cavity. Alternatively, the edge walls can be upright. Incorporation of the expansion within the roof of the cavity can be brought about in various ways. One possibility is to press form the expansion integrally with the roof sheet and in this fashion eliminate potential sealing problems between the expansion and roof. Alternatively, the expansion can be press formed from suitable sheet material and then joined along the edges of an aperture provided in the roof of the cavity, by welding and/or crimping.

FIG. 2*c* shows the cavity of FIG. 2*a*, in perspective, obliquely, from the front and beneath, looking through the interior of the cavity into the interior of the expansion 9. Two relatively long grill elements 17 are disposed in the expansion. The grill elements extend into the through holes 14 depicted in FIG. 2*b* to make electrical contact with their intended power source in the microwave oven. The electrical connections of the grill elements are as conventional in this art. FIG. 2*c* also shows the feed aperture 10 of the microwave input means 7.

The grill elements can, for example, consist of a spiral heating filament which is wound around a shank or tube of ceramic or other heat resistant material. By placing the grill elements in the expansion they have an entirely concealed position in the cavity which does not encroach on the available cavity space and, as previously stated, do not affect the part of the microwave field in the load zone which is important to the cooking process. Due to its inclined sides 19, the expansion has the form of a reflector which assists in directing heat radiation from the grill element towards the load zone. In this fashion, an improved grilling result is achieved even using a grill element of smaller dimensions.

It should be appreciated that many alternative embodiments of the expansion are conceivable within the spirit and scope of the invention, as are alternative placings of the expansion which share the feature of a microwave feed into the cavity ensuring that the E- and H-vectors of the microwave field exhibit the defined orientations relative to the plane defined by the opening of the expansion. For example, the expansion can be disposed in a lateral wall of the cavity in order to provide room for cooking receptacles which are somewhat broader than is normally the case. To provide an optimally even, directed distribution of heat radiation, the interior of the expansion can be finished with a reflective coating and have a more refined reflector shape. The expansion may also be used for oven lighting and accomodate a "concealed" light source in which the expansion is configured as a light reflector in order to provide even light in the cavity. In the case of a grill element, the expansion can be covered with a protective sheet having perforations to allow passage of heat radiation, while in the case of oven lighting, the expansion can be covered with a piece of glass or other transparent material, which piece can have a surface structure assisting light distribution.

What is claimed is:

1. A microwave oven comprising an oven cavity having a given volume into which a food item is placed during cooking, the cavity being enclosed by walls in conjunction with an oven door, and a microwave source with associated microwave input means for producing a microwave field in the cavity during cooking operation, comprising a zone defined by an expansion of one of said walls, said zone increasing said given volume for said cavity, said zone having one side thereof opening into said cavity, and dimensions that are tuned to the wavelength and field pattern of the microwave field in the cavity, including length of the expansion zone in the direction of microwave propogation along said wall essentially corresponding to a whole number of microwave half wavelengths, and said input means is arranged to input microwaves which are polarized such that the electric field vector of the microwave field is formed substantially at right angles to a plane defined by said one side opening into said cavity and the magnetic field vector of the microwave field is directed substantially parallel to said plane.

2. A microwave oven according to claim 1 wherein the expansion zone is disposed in the roof of the cavity and is essentially in the form of a flat, rectangular, box-shape with two substantially parallel broad faces, respectively defining the opening into said cavity and the roof of the expansion zone.

3. A microwave oven according to claim 2, further comprising a grill element, the grill element disposed in the expansion zone and the expansion zone configured as a reflector to direct heat radiation from the grill element towards the food item placed in the cavity.

4. A microwave oven according to claim 3, wherein the expansion zone has a length of the order of magnitude of 2 wavelengths, a breadth of the order of magnitude of 1 wavelength and a depth less than or equal to half of a wavelength.

5. A microwave oven according to claim 4 wherein the cavity is essentially parallipedal in form with a rectangular floor, ceiling and pair of opposed lateral walls, and in which the microwave field is essentially unaffected by the load due to said input means comprising a waveguide device which is tuned to the actual wavelength employed and two feed apertures in one of the lateral walls respectively adjacent the floor and roof of the cavity which are arranged to input coherent, phase locked microwave transmissions with a substantially vertical electric field vector and the expansion zone is disposed centrally in the roof of the cavity and symmetrically in relation to the delimiting edges of the roof.

* * * * *